US010704114B2

(12) United States Patent
Könberg et al.

(10) Patent No.: US 10,704,114 B2
(45) Date of Patent: Jul. 7, 2020

(54) PROCESS OF PRODUCING A DUPLEX STAINLESS STEEL TUBE

(71) Applicant: Sandvik Intellectual Property AB, Sandviken (SE)

(72) Inventors: Erik Könberg, Älvsjö (SE); Daniel Svedberg, Gävle (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 16/066,156

(22) PCT Filed: Dec. 28, 2016

(86) PCT No.: PCT/EP2016/082739
§ 371 (c)(1),
(2) Date: Jun. 26, 2018

(87) PCT Pub. No.: WO2017/114847
PCT Pub. Date: Jul. 6, 2017

(65) Prior Publication Data

US 2019/0010569 A1 Jan. 10, 2019

(30) Foreign Application Priority Data

Dec. 30, 2015 (EP) ..... 15203149

(51) Int. Cl.

| | |
|---|---|
| ***C21D 9/08*** | (2006.01) |
| ***C21D 8/10*** | (2006.01) |
| ***B21C 23/08*** | (2006.01) |
| ***C22C 1/02*** | (2006.01) |
| ***B21B 23/00*** | (2006.01) |
| ***C22C 38/00*** | (2006.01) |
| ***C22C 38/58*** | (2006.01) |
| ***C21D 6/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| *B21B 3/02* | (2006.01) |

(52) U.S. Cl.

CPC ..... *C21D 9/08* (2013.01); *B21B 23/00* (2013.01); *B21C 23/08* (2013.01); *B21C 23/085* (2013.01); *C21D 6/004* (2013.01); *C21D 6/005* (2013.01); *C21D 6/008* (2013.01); *C21D 8/10* (2013.01); *C21D 8/105* (2013.01); *C21D 9/085* (2013.01); *C22C 1/02* (2013.01); *C22C 38/00* (2013.01); *C22C 38/001* (2013.01); *C22C 38/02* (2013.01); *C22C 38/04* (2013.01); *C22C 38/42* (2013.01); *C22C 38/44* (2013.01); *C22C 38/58* (2013.01); *B21B 3/02* (2013.01); *B21B 2261/08* (2013.01); *B21B 2261/10* (2013.01); *C21D 2211/001* (2013.01); *C21D 2211/005* (2013.01)

(58) Field of Classification Search

CPC ..... C21D 9/08; C21D 8/105
USPC ..... 148/506
See application file for complete search history.

(56) References Cited

U.S. PATENT DOCUMENTS

| | | | | |
|---|---|---|---|---|
| 6,051,081 | A | 4/2000 | Valle Echevarria et al. | |
| 9,617,628 | B2 | 4/2017 | Bergstrom et al. | |
| 2011/0290377 | A1* | 12/2011 | Suwabe | B21C 23/085 148/506 |

FOREIGN PATENT DOCUMENTS

| | | | |
|---|---|---|---|
| CN | 104962836 | A | 10/2015 |
| EP | 2177634 | A1 | 4/2010 |
| EP | 2388341 | A1 | 11/2011 |
| EP | 2853614 | A1 | 4/2015 |
| JP | 2014-40671 | A | 3/2014 |
| KR | 10-2013-0109367 | A | 10/2013 |

OTHER PUBLICATIONS

International Search Report and Written Opinion dated Mar. 29, 2017, issued in corresponding International Application No. PCT/EP2016/082739.

Chinese Office Action issued in Chinese Patent Application No. 201680077169.4 dated Jan. 2, 2019.

Korean Decision for Grant of Patent issued in Korean Patent Application No. 10-2018-7021492 dated Jan. 28, 2019.

* cited by examiner

*Primary Examiner* — Weiping Zhu

(74) *Attorney, Agent, or Firm* — Morgan, Lewis & Bockius LLP

(57) ABSTRACT

A process of producing a duplex stainless steel tube comprises the steps of:

a) producing an ingot or a continuous casted billet of said duplex stainless steel;
b) hot extruding the ingot or the billet obtained from step a) into a tube; and
c) cold rolling the tube obtained from step b) to a final dimension thereof.

The outer diameter D and the wall thickness t of the cold rolled tube is 50-250 mm respectively is 5-25 mm, and, for the cold rolling step, R and Q are set such that the following formula is satisfied:

$$Rp0.2\text{target}=416.53+113.26\cdot\log Q+4.0479\cdot R+2694.9\cdot C\,\%-82.750\cdot(\log Q)^2-0.04279\cdot R^2-2.2601\cdot\log Q\cdot R+16.9\cdot Cr\,\%+26.1\cdot Mo\,\%+83.6\cdot N\,\%+Z \quad (1)$$

wherein Rp0.2target is targeted yield strength and is 800-1100 MPa and $0<Q<3.6$.

10 Claims, No Drawings

PROCESS OF PRODUCING A DUPLEX STAINLESS STEEL TUBE

TECHNICAL FIELD

The present disclosure relates to a process of producing a duplex stainless steel tube.

BACKGROUND

Duplex stainless steel tubes having the composition defined hereinafter are used in a wide variety of applications in which they are subjected to corrosive media as well as substantive mechanical load. During the production of such duplex stainless steel tubes, different process parameters have to be set correctly in order to obtain a steel tube having the desired yield strength. Process parameters that have been found to have important impact on the final yield strength of the material are the following: degree of hot deformation, degree of cold deformation and ratio between tube diameter and tube wall reduction during the process in which a hot extruded tube is cold rolled to its final dimensions. These process parameters have to be set with regard to the specific composition of the duplex stainless steel and the desired yield strength of the duplex stainless steel tube.

Up to this point, prior art has relied upon performing extensive trials in order to find process parameter values resulting in the achievement of a target yield strength of duplex stainless steel tubes. Such trials are laborious and costly. Therefore, a more cost-efficient process for determining process parameters crucial to the yield strength is desirable.

EP 2 388 341 suggests a process for producing a duplex stainless steel tube having a specific chemical composition, wherein the working ratio (%) in terms of reduction of area in the final cold rolling step is determined for a predetermined targeted yield strength of the tube by means of a given formula that also includes the impact of certain alloying elements on the relationship between working ratio and targeted yield strength.

The present disclosure aims at presenting an alternative process for manufacturing a tube of a duplex stainless steel by setting a Q-value, as defined hereinafter, and a cold reduction R, as defined hereinafter, in order to achieve a targeted yield strength of the produced duplex stainless steel tube, and thereby improving the total manufacturing efficiency.

DETAILED DESCRIPTION

Hence, the present disclosure therefore relates to a process of producing a duplex stainless steel tube, said duplex stainless steel having the following composition (in weight %),

| | |
|---|---|
| C | 0-0.3; |
| Cr | 22-26; |
| Cu | 0-0.5; |
| Mn | 0-1.2; |
| Mo | 3.0-4.0, |
| N | 0-0.35; |
| Ni | 5.0-7.0; |
| Si | 0.2-0.8; |

balance Fe and unavoidable impurities, said process comprising the steps of a) producing an ingot or a continuous casted billet of said duplex stainless steel;

b) hot extruding the ingot or the billet obtained from step a) into a tube; and c) cold rolling the tube obtained from step b) to a final dimension thereof;

wherein the outer diameter D and the wall thickness t of the cold rolled tube is 50-250 mm respectively is 5-25 mm, wherein, for the cold rolling step, R and Q are set such that the following formula is satisfied:

$$Rp0.2\text{target}=416.53+113.26\cdot\log Q+4.0479\cdot R+2694.9\cdot C\ \%-82.750\cdot(\log Q)^2-0.04279-R^2-2.2601\cdot\log Q\cdot R+16.9\cdot Cr\ \%+26.1\cdot Mo\ \%+83.6\cdot N\ \%\pm Z \quad (1)$$

wherein

Rp0.2target is targeted yield strength and is 800-1100 MP, $$Q=(W0-W1)\times(OD0-W0)/W0((OD0-W0)-(OD1-W1)) \quad (2)$$

wherein W1 is tube wall thickness before cold rolling, W0 is tube wall thickness after cold rolling, OD1 is outer diameter of tube before cold rolling, and OD0 is outer diameter of tube after cold rolling, R is cold reduction and is defined as $$R = 1 - \frac{A1}{A0} \quad (3)$$

wherein A1 is tube cross section area before cold rolling and A0 is tube cross section area after cold rolling $Z=65$, and wherein $0<Q<3.6$.

The relationship presented by formula (1) will make it possible to determine the process parameter values for R and Q on the basis of the composition of the duplex stainless steel, i.e. the content of elements C, Cr, Mo and N, and the targeted yield strength of the obtained tube The targeted yield strength is in the range of from 800-1100 MPa, such as 900-1100 MPa.

Formula (1) could be written as follows: $Rp0.2\text{target}-Z\leq 416.53+113.26\cdot\log Q+4.0479\cdot R+2694.9\cdot C\ \%-82.750\cdot(\log Q)^2-0.04279\cdot R^2-2.2601\cdot\log Q\cdot R+16.9\cdot Cr\ \%+26.1\cdot Mo\ \%+83.6\cdot N\ \%\leq Rp0.2\text{target}+Z$ According to one embodiment, Z=50. According to another embodiment, Z=20. According to yet another embodiment, Z=0.

On basis of the composition of a duplex stainless steel and target yield strength of the tube to be produced, the values of R and Q may be set by means of an iterative calculation procedure which aims at finding those values for R and Q for which equation (1) is satisfied.

$$\text{Cold reduction } R \text{ is defined as } R = 1 - \frac{A1}{A0} \quad (3)$$

Wherein A1 is tube cross section area before cold deformation and A0 is tube cross section area after cold deformation.

As to the composition of the duplex stainless steel, the following is to be noted regarding the individual alloying elements therein:

Carbon, C is a representative element for stabilizing austenitic phase and an important element for maintaining mechanical strength. However, if a large content of carbon is used, carbon will precipitate as carbides and thus reduces corrosion resistance. According to one embodiment, the carbon content of the duplex stainless steel used in the process disclosed hereinbefore and hereinafter is 0 to 0.3 wt %. According to one embodiment, the carbon content is of from 0.008 to 0.03 wt %, such as 0.008 to 0.2 wt %.

Chromium, Cr, has strong impact on the corrosion resistance of the duplex stainless steel as defined hereinabove or hereinafter, especially pitting corrosion. Cr improves the yield strength, and counteracts transformation of austenitic structure to martensitic structure upon deformation of the duplex stainless steel. However, an increasing content of Cr will result in for the formation of unwanted stable chromium nitride and sigma phase and a more rapid generation of sigma phase. According to one embodiment, the chromium content of the duplex stainless steel used in the process disclosed hereinbefore and hereinafter is of from 22 to 26 wt %, such as 23 to 25 wt %.

Copper, Cu, has a positive effect on the corrosion resistance. Cu is either added purposively to the duplex stainless steel as defined hereinabove or hereinafter or is already present in scrapped goods used for the production of steel, and is allowed to remain therein. Too high levels of Cu will result in reduced hot workability and toughness and should therefore be avoided for those reasons. According to one embodiment, the copper content of the duplex stainless steel used in the process disclosed hereinbefore and hereinafter is of from 0-0.5 wt %, such as 0-0.2 wt %. According to one embodiment, the copper content is 0.1-0.2 wt %.

Manganese, Mn, has a deformation hardening effect on the duplex stainless steel as defined hereinabove or hereinafter. Mn is also known to form manganese sulfide together with sulfur present in the steel, thereby improving the hot workability. However, at too high levels, Mn tends to adversely affect both corrosion resistance and hot workability. According to one embodiment, the manganese content of the duplex stainless steel used in the process disclosed hereinbefore and hereinafter is 0 to 1.2 wt %, such as 0 to 1.0 wt % According to one embodiment, the manganese content is of from 0.35 to 1.0 wt %, such as 0.40 to 0.9 wt %.

Molybdenum, Mo, has a strong influence on the corrosion resistance of the duplex stainless steel as defined hereinabove or hereinafter and it heavily influences the pitting resistance equivalent, PRE. Mo has also a positive effect on the yield strength and increases the temperature at which the unwanted sigma-phases are stable and further promotes generation rate thereof. Additionally, Mo has a ferrite-stabilizing effect. According to one embodiment, the molybdenum content of the duplex stainless steel used in the process disclosed hereinbefore and hereinafter is of from 3.0 to 4.0 wt %.

Nickel, Ni, has a positive effect on the resistance against general corrosion. Ni also has a strong austenite-stabilizing effect. According to one embodiment, the nickel content of the duplex stainless steel used in the process disclosed hereinbefore and hereinafter is of from 5.0 to 7.0 wt %, such as 5.5 to 6.5 wt %.

Nitrogen, N, has a positive effect on the corrosion resistance of the duplex stainless steel as defined hereinabove or hereinafter and also contributes to deformation hardening. It has a strong effect on the pitting corrosion resistance equivalent PRE (PRE=Cr+3.3Mo+16N) and has also a strong austenite stabilizing effect and counteracts transformation from austenitic structure to martensitic structure upon plastic deformation of the duplex stainless steel. According to one embodiment, the nitrogen content of the duplex stainless steel used in the process disclosed hereinabove or hereinafter is 0 to 0.35 wt %. According to an alternative embodiment, N is added in an amount of 0.1 wt % or higher. However, at too high levels, N tends to promote chromium nitrides, which should be avoided due to their negative effect on ductility and corrosion resistance. Thus, according to one embodiment, the content of N is therefore less than or equal to 0.35 wt %, such as 0.1 to 0.35 wt %.

Silicon, Si, is often present in the duplex stainless steel since it may have been added for deoxidization earlier in the production thereof. Too high levels of Si may result in the precipitation of intermetallic compounds in connection to later heat treatments or welding of the duplex stainless steel. Such precipitations will have a negative effect on both the corrosion resistance and the workability. According to one embodiment, the silicon content of the duplex stainless steel used in the process disclosed hereinabove or hereinafter is of from 0.2 to 0.8 wt %, such as 0.2 to 0.8 wt %, such as 0.3 to 0.6 wt %.

Phosphorous, P, may be present as an impurity in the stainless steel used in the process disclosed hereinabove or hereinafter, and will result in deteriorated workability of the steel if at too high level, thus, P≤0.04 wt %.

Sulphur, S, may be present as an impurity in the stainless steel used in the process disclosed hereinabove or hereinafter and will result in deteriorated workability of the steel if at too high level, thus, S≤0.03 wt %.

Oxygen, O, may be present as an impurity in the stainless steel used in the process disclosed hereinabove or hereinafter, wherein O≤0.010 wt %.

Optionally small amounts of other alloying elements may be added to the duplex stainless steel as defined hereinabove or hereinafter in order to improve e.g. the machinability or the hot working properties, such as the hot ductility. Example, but not limiting, of such elements are REM, Ca, Co, Ti, Nb, W, Sn, Ta, Mg, B, Pb and Ce. The amounts of one or more of these elements are of max 0.5 wt %. According to one embodiment, the duplex stainless steel as defined hereinabove or herein after may also comprise small amounts other alloying elements which may have been added during the process, e.g. Ca (≤0.01 wt %), Mg (≤0.01 wt %), and rare earth metals REM (≤0.2 wt %).

When the terms "max" or "less than or equal to" are used, the skilled person knows that the lower limit of the range is 0 wt % unless another number is specifically stated. The remainder of elements of the duplex stainless steel as defined hereinabove or hereinafter is Iron (Fe) and normally occurring impurities.

Examples of impurities are elements and compounds which have not been added on purpose, but cannot be fully avoided as they normally occur as impurities in e.g. the raw material or the additional alloying elements used for manufacturing of the martensitic stainless steel.

According to one embodiment, the duplex stainless steel consist of the alloying elements disclosed hereinabove or hereinafter in the ranges as disclosed hereinabove or hereinafter, According to one embodiment, the duplex stainless steel used in the process as defined hereinabove or hereinafter contains 30-70 vol. % austenite and 30-70 vol. % ferrite.

According to one embodiment, the duplex stainless steel used in the process disclosed hereinabove or hereinafter has the following composition (in weight %),

| | |
|---|---|
| C | 0.008-0.03; |
| Cr | 22-26; |
| Cu | 0.1-0.2; |
| Mn | 0.35-1.0; |
| Mo | 3.0-4.0; |
| N | 0.1-0.35; |
| Ni | 5.0-7.0; |
| Si | 0.2-0.7; |

balance Fe and unavoidable impurities.

According to one embodiment, if 0<Q<1, then 25*Q<R<40*Q+20.

According to one embodiment, if 1≤Q≤2, then 25*Q≤R≤60.

According to one embodiment, if 2<Q<3.6, then 50<R<60.

According to one embodiment, for the cold rolling step, R and Q are set such that the following formula is satisfied:

$$Rp0.2target = 416.53 + 113.26 \cdot \log Q + 4.0479 \cdot R + 2694.9 \cdot C\ \% - 82.750 \cdot (\log Q)^2 - 0.04279 \cdot R^2 - 2.2601 \cdot \log Q \cdot R + 16.9 \cdot Cr\ \% + 26.1 \cdot Mo\ \% + 83.6 \cdot N\ \%.$$

Accordingly, formula (1) is used, wherein Z=0.

The present disclosure is further illustrated by the following non-limiting examples:

Examples

Melts of steel of duplex stainless steel of different chemical composition were prepared in an electric arc furnace. An AOD furnace was used in which decarburisation and desulphurisation treatment was conducted. The melts were then either casted into ingots (for production of tubes having larger outer diameter than 110 mm) or into billets by means of continuous casting (for production of tubes having smaller diameter than 110 mm). The casted stainless steel of the different melts were analysed with regard to chemical composition. Results are presented in table 1.

TABLE 1

The chemical compositions of the different melts

| Test No. | C | Cr | Cu | Mn | Mo | N | Ni | Si |
|---|---|---|---|---|---|---|---|---|
| 1 | 0.010 | 25.28 | 0.14 | 0.53 | 3.84 | 0.30 | 6.45 | 0.30 |
| 2 | 0.015 | 25.55 | 0.13 | 0.40 | 3.90 | 0.30 | 6.70 | 0.28 |
| 3 | 0.015 | 25.55 | 0.13 | 0.40 | 3.90 | 0.30 | 6.70 | 0.28 |
| 4 | 0.012 | 25.67 | 0.13 | 0.60 | 3.85 | 0.30 | 6.51 | 0.27 |
| 5 | 0.012 | 25.67 | 0.13 | 0.60 | 3.85 | 0.30 | 6.51 | 0.27 |
| 6 | 0.012 | 25.49 | 0.12 | 0.36 | 3.89 | 0.29 | 6.44 | 0.25 |

TABLE 1-continued

The chemical compositions of the different melts

| Test No. | C | Cr | Cu | Mn | Mo | N | Ni | Si |
|---|---|---|---|---|---|---|---|---|
| 7 | 0.012 | 25.49 | 0.12 | 0.36 | 3.89 | 0.29 | 6.44 | 0.25 |
| 8 | 0.012 | 25.67 | 0.13 | 0.60 | 3.85 | 0.30 | 6.51 | 0.27 |
| 9 | 0.012 | 25.67 | 0.13 | 0.60 | 3.85 | 0.30 | 6.51 | 0.27 |
| 10 | 0.012 | 22.38 | 0.13 | 0.88 | 3.17 | 0.16 | 5.34 | 0.48 |
| 11 | 0.015 | 22.27 | 0.19 | 0.82 | 3.17 | 0.18 | 5.20 | 0.48 |
| 12 | 0.016 | 22.31 | 0.18 | 0.80 | 3.14 | 0.16 | 5.20 | 0.55 |
| 13 | 0.016 | 22.32 | 0.11 | 0.77 | 3.14 | 0.18 | 5.19 | 0.49 |
| 14 | 0.015 | 22.27 | 0.19 | 0.82 | 3.17 | 0.18 | 5.20 | 0.48 |
| 15 | 0.013 | 22.43 | 0.14 | 0.81 | 3.16 | 0.18 | 5.21 | 0.50 |
| 16 | 0.013 | 22.35 | 0.17 | 0.77 | 3.15 | 0.18 | 5.21 | 0.49 |
| 17 | 0.023 | 22.27 | 0.13 | 0.85 | 3.16 | 0.17 | 5.15 | 0.49 |
| 18 | 0.015 | 22.32 | 0.14 | 0.81 | 3.15 | 0.18 | 5.22 | 0.47 |
| 19 | 0.016 | 22.34 | 0.18 | 0.76 | 3.14 | 0.18 | 5.18 | 0.48 |
| 20 | 0.016 | 22.51 | 0.15 | 0.86 | 3.19 | 0.17 | 5.23 | 0.50 |
| 21 | 0.014 | 22.39 | 0.15 | 0.84 | 3.16 | 0.17 | 5.21 | 0.50 |
| 22 | 0.014 | 22.37 | 0.14 | 0.83 | 3.15 | 0.17 | 5.28 | 0.48 |
| 23 | 0.019 | 22.31 | 0.17 | 0.75 | 3.14 | 0.17 | 5.20 | 0.50 |
| 24 | 0.015 | 22.32 | 0.14 | 0.81 | 3.15 | 0.18 | 5.22 | 0.47 |
| 25 | 0.012 | 22.38 | 0.13 | 0.88 | 3.17 | 0.16 | 5.34 | 0.48 |
| 26 | 0.015 | 22.30 | 0.13 | 0.79 | 3.14 | 0.18 | 5.19 | 0.50 |
| 27 | 0.016 | 22.32 | 0.15 | 0.78 | 3.18 | 0.18 | 5.25 | 0.51 |
| 28 | 0.023 | 22.38 | 0.13 | 0.82 | 3.17 | 0.16 | 5.24 | 0.46 |
| 29 | 0.016 | 25.64 | 0.13 | 0.5 | 3.83 | 0.3 | 6.48 | 0.34 |
| 30 | 0.014 | 22.25 | 0.16 | 0.77 | 3.15 | 0.17 | 5.21 | 0.49 |
| 31 | 0.017 | 22.41 | 0.16 | 0.78 | 3.27 | 0.20 | 5.20 | 0.48 |

The produced ingots or billets were subjected to a heat deformation process in which they were extruded into a plurality of tubes. These tubes were subjected to a cold deformation in which they were cold rolled in a pilger mill to their respective final dimensions. For each of the test numbers presented in table 1, 10-40 of tubes were thus produced using the same R and Q (and thus ingoing outer diameter and ingoing wall thickness) were determined with regard taken to the target yield strength such that equation 1 presented hereinabove was satisfied. The cold rolling was performed in one cold rolling step.

For each tube, the yield strength was measured for two test samples in accordance with ISO 6892, thus resulting in a plurality of yield strength measurements for each test number. For each test number, average yield strength was calculated on basis of said measurement. The average yield strength was compared to the target yield strength which was calculated by means of equation 1 presented hereinabove. Results are presented in table 2. More precisely, a target yield strength was determined and, on basis thereof and the composition of the duplex stainless steel, Q and R were determined by means of equation (1), whereupon tubes were produced in accordance with the teaching presented hereinbefore and hereinafter and yield strength was measured in the way disclosed hereinabove. The deviation of the individual measurements from the targeted yield strength was also registered. Deviations were less than +/−65 MPa from the targeted yield strength.

TABLE 2

Result of calculations

| Test No | Q | Reduction | Outgoing OuterDiameter | Outgoing WallThickness | Rp0.2target | Rp0.2 Actual Average |
|---|---|---|---|---|---|---|
| 1 | 0.23 | 10.0 | 192.2 | 20.7 | 940.6 | 925.0 |
| 2 | 0.27 | 10.2 | 158.75 | 22.2 | 974.1 | 959.9 |
| 3 | 0.27 | 10.2 | 158.75 | 22.2 | 974.1 | 959.9 |
| 4 | 0.23 | 10.0 | 192.2 | 20.7 | 952.8 | 960.0 |
| 5 | 0.23 | 10.0 | 192.2 | 20.7 | 952.8 | 960.0 |
| 6 | 0.30 | 10.7 | 139.7 | 7.72 | 975.1 | 964.8 |
| 7 | 0.30 | 10.7 | 139.7 | 7.72 | 975.1 | 964.8 |

TABLE 2-continued

| Result of calculations | | | | | | |
|---|---|---|---|---|---|---|
| Test No | Q | Reduction | Outgoing OuterDiameter | Outgoing WallThickness | Rp0.2target | Rp0.2 Actual Average |
| 8 | 0.23 | 10.0 | 192.2 | 20.7 | 952.8 | 972.0 |
| 9 | 0.23 | 10.0 | 192.2 | 20.7 | 952.8 | 972.0 |
| 10 | 3.24 | 55.7 | 178.5 | 10.36 | 987.9 | 977.0 |
| 11 | 3.24 | 55.7 | 178.5 | 10.36 | 995.8 | 982.0 |
| 12 | 3.24 | 55.7 | 178.5 | 10.36 | 996.8 | 992.0 |
| 13 | 3.24 | 55.7 | 178.5 | 10.36 | 998.5 | 994.0 |
| 14 | 3.24 | 55.7 | 178.5 | 10.36 | 995.8 | 1004.0 |
| 15 | 1.33 | 56.1 | 114.6 | 7.37 | 1017.6 | 1009.0 |
| 16 | 1.17 | 40.7 | 127.5 | 15.8 | 1021.5 | 1009.0 |
| 17 | 3.24 | 55.7 | 178.5 | 10.36 | 1016.2 | 1011.0 |
| 18 | 1.17 | 40.7 | 127.5 | 15.8 | 1026.4 | 1016.0 |
| 19 | 1.49 | 58.9 | 114.6 | 6.88 | 1018.2 | 1017.0 |
| 20 | 1.33 | 56.1 | 114.6 | 7.37 | 1027.0 | 1020.0 |
| 21 | 1.49 | 58.9 | 114.6 | 6.88 | 1013.4 | 1024.0 |
| 22 | 1.33 | 56.1 | 114.6 | 7.37 | 1018.2 | 1025.0 |
| 23 | 1.33 | 56.1 | 114.6 | 7.37 | 1030.4 | 1027.0 |
| 24 | 1.17 | 40.7 | 127.5 | 15.8 | 1026.4 | 1028.0 |
| 25 | 0.80 | 35.8 | 196.0 | 20.6 | 1009.3 | 1029.0 |
| 26 | 1.49 | 58.9 | 114.6 | 6.88 | 1014.9 | 1030.0 |
| 27 | 1.49 | 58.9 | 114.6 | 6.88 | 1019.0 | 1033.0 |
| 28 | 1.33 | 56.1 | 114.6 | 7.37 | 1042.3 | 1034.0 |
| 29 | 0.32 | 27.5 | 86.6 | 14.4 | 1052.0 | 1034.0 |
| 30 | 0.79 | 47.0 | 85.4 | 13.7 | 1020.8 | 1035.0 |
| 31 | 1.33 | 56.1 | 114.6 | 7.37 | 1032.6 | 1046.0 |

Wherein "outgoing outer diameter" is tube diameter after cold rolling and "outgoing wall thickness" is tube wall thickness after cold rolling.

It can thus be concluded that equation (1) is an excellent tool for setting R and Q on basis of the chemical composition of a duplex stainless steel and a chosen target yield strength. For a particular tube, having a predetermined final outer diameter and predetermined final wall thickness, and outgoing from a billet of predetermined geometry, in particular cross-sectional area, the use of equation (1) will enable the skilled practitioner to choose a suitable hot reduction as well as cold reduction and Q-value without need of experimentation. Iterative calculation may be used in order to arrive at satisfaction of equation (1). Provided that equation (1) is satisfied, and the that the duplex stainless steel has a composition as defined hereinabove, the yield strength of individual tube samples from one and the same ingot or billet will not deviate more than approximately +/−65 MPa from the targeted yield value.

The invention claimed is:

1. A process of producing a duplex stainless steel tube, the process comprising:

producing an ingot or a continuous casted billet of the duplex stainless steel;

hot extruding the produced ingot or the produced billet into a tube;

selecting a cold reduction (R) and a Q-value (Q) to be used in cold rolling so as to obtain a value for targeted yield strength (Rp0.2target) that is 1000-1100 MPa and a value for Q-value (Q) is 0<Q<3.6; and cold rolling the hot extruded tube to a final dimension using the selected cold reduction (R) and Q-value (Q), wherein the cold reduction (R) is defined as:

$$R = 1 - \frac{A1}{A0}$$

where A1 is tube cross section area before cold rolling and A0 is tube cross section area after cold rolling, wherein the Q-value (Q) is calculated using the following formula:

$$Q=(W0-W1)\times(OD0-W0)/W0((OD0-W0)-(OD1-W1))$$

where

W1 is tube wall thickness before cold rolling,

W0 is tube wall thickness after cold rolling,

OD1 is outer diameter of tube before cold rolling, and

OD0 is outer diameter of tube after cold rolling, wherein the value for targeted yield strength (Rp0.2target) is calculated using the following formula:

$$Rp0.2target = 416.53 + 113.26\cdot\log Q + 4.0479\cdot R + 2694.9\cdot C\ \% - 82.750\cdot(\log Q)^2 - 0.04279\cdot R^2 - 2.2601\cdot\log Q\cdot R + 16.9\cdot Cr\ \% + 26.1\cdot Mo\ \% + 83.6\cdot N\ \% \pm Z,$$

wherein Z=65, 50, 20 or 0, and wherein the duplex stainless steel has a composition including (in weight %):

| | |
|---|---|
| C | 0-0.3, |
| Cr | 22-26, |
| Cu | 0-0.5, |
| Mn | 0-1.2, |
| Mo | 3.0-4.0, |
| N | 0-0.35, |
| Ni | 5.0-7.0, |
| Si | 0.2-0.8, |

and balance Fe and unavoidable impurities.

2. The process according to claim 1, wherein the outer diameter of the tube after cold rolling is 50-250 mm, and wherein the tube wall thickness after cold rolling is 5-25 mm.

3. The process according to claim 2, wherein, if $0<Q<1$, then $25*Q<R<40*Q+20$.

4. The process according to claim 2, wherein, if $1\leq\leq2$, then $25*Q\leq R\leq60$.

5. The process according to claim 2, wherein, if $2<Q<3.6$, then $50<R<60$.

6. The process according to claim 2, wherein the duplex stainless steel contains 30-70 vol. % austenite and 30-70 vol. % ferrite.

7. The process according to claim 2, said duplex stainless steel having the following composition (in weight %),

| | |
|---|---|
| C | 0.008-0.03; |
| Cr | 22-26; |
| Cu | 0.1-0.2; |
| Mn | 0.35-1.0; |
| Mo | 3.0-4.0 |
| N | 0.1-0.35; |
| Ni | 5.0-7.0; |
| Si | 0.2-0.7; |

and balance Fe and unavoidable impurities.

8. The process according to claim 2, wherein Z=50.

9. The process according to claim 2, wherein Z=20.

10. The process according to claim 2, wherein Z=0.

* * * * *